United States Patent [19]

Jennings

[11] Patent Number: 4,586,308

[45] Date of Patent: May 6, 1986

[54] WALL PANEL

[75] Inventor: Harriet E. Jennings, Westport, Conn.

[73] Assignee: U.S. Plywood Corporation, Wilton, Conn.

[21] Appl. No.: 740,820

[22] Filed: Jun. 3, 1985

[51] Int. Cl.[4] ..... E04B 1/62

[52] U.S. Cl. ..... 52/393; 52/417; 52/573

[58] Field of Search ..... 52/478, 416, 417, 420, 52/573, 393, 394

[56] References Cited

U.S. PATENT DOCUMENTS

| | | | |
|---|---|---|---|
| 2,054,246 | 9/1936 | Dalzell . | |
| 3,111,787 | 11/1963 | Chamberlain . | |
| 3,468,086 | 9/1969 | Warner | 52/173 |
| 3,708,935 | 1/1973 | Kossuth et al. | 52/416 |
| 3,740,910 | 6/1973 | Taylor et al. | 52/420 X |
| 4,063,395 | 12/1977 | Stewart et al. | 52/417 X |

FOREIGN PATENT DOCUMENTS

| | | |
|---|---|---|
| 675101 | 12/1963 | Canada . |
| 790248 | 11/1935 | France . |
| 791852 | 12/1980 | U.S.S.R. . |

*Primary Examiner*—Carl D. Friedman
*Attorney, Agent, or Firm*—Perman & Green

[57] ABSTRACT

A panel is provided to enable easy and fast installation with well hidden seams. The panel includes a substrate to which a face layer is adhered. The face layer is free of the substrate adjacent the two side edges thereof. Additionally, the face layer overhangs one side edge. A resilient strip of material is adhered to the substrate adjacent the edge of the panel having the overhanging face layer.

12 Claims, 9 Drawing Figures

WALL PANEL

BACKGROUND OF THE INVENTION

Wall panels formed from laminated wood, coated particle board or gypsum board are widely used in the construction industry because of the relatively low cost of these panels and the ease of handling and installing the panels. More particularly, panels of this type generally are four feet wide and eight or more feet long. Thus, a large area of a wall can be covered with a single panel. Additionally, the panels generally can be formed with inexpensive but structurally sufficient substrates to which a thin decorative layer is laminated. The resulting structure is well suited to automated manufacture at a low cost. On many panels, such as gypsum panels, coasts are held even lower by providing a top layer that is merely a non-decorative paper that can readily be painted or otherwise coated.

One of the few disadvantages of the prior art wall panels is that they leave visually apparent seams at the juncture of adjacent panels. Many wall panels require the application of a filler, such as plaster or an acrylic material, to fill the area adjacent the seams. The proper use of such fillers often requires at least as much time as the time required to secure the panels to the wall. For example, some panels require sequential applications of plaster, paper tape and more plaster over the seam. The plaster is allowed to dry for several hours. The covered seam then must be sanded, recoated and sanded again. Other panels require the application of an acrylic filler in lieu of plaster. These fillers generally do not require a paper tape, but they are difficult to handle and invariably require extensive sanding.

Fillers generally must be applied by a skilled craftsman to avoid leaving an obtrusive indication of the seam. Furthermore, many widely used panels include a decorative top coating that can not reasonably be used with a filler. Panels of this type often attempt to make the seam aesthetically attractive rather than trying to cover or camouflage the seam. For example, the edges of the panels may be beveled to provide reasonably attractive grooves at the junctures of adjacent panels. Alternatively, panels may be employed with molding strips that can be applied between abutting edges.

Several attempts have been to provide panels that will successfully hide the seams. For example, U.S. Pat. No. 2,054,246 which issued to Dalzell on Sept. 15, 1936 shows a wallboard wherein the face layer of each panel is spaced inwardly from a first longitudinal edge, but overhangs the second longitudinal edge by an equivalent amount. A plurality of panels according to U.S. Pat. No. 2,054,246 are disposed such that the respective disimilar edges of adjacent panels are in abutting relationship. Thus, the overhanging face layer of one panel will be mounted to the edge of an adjacent panel having an inwardly spaced face layer. In this manner, the panels of U.S. Pat. No. 2,054,246 are intended to hide the seams between adjacent panels.

U.S. Pat. No. 3,11,787 which issued to Chamberlain on Nov. 26, 1963 shows a roofing panel having a plurality of laminated layers including an outer layer of roofing felt. One edge of the roofing felt overhangs the rest of the panel. This overhanging edge of the roofing felt in U.S. Pat. No. 3,111,787 includes a layer of adhesive on the inwardly facing side to which a release paper is removably secured. As the panels are positioned, the respective overhanging portions of the roofing felt overlap the adjacent panel. This overlap is made more secure by removing the release paper such that the overhanging roofing felt can be secured to the adjacent panel by the preapplied adhesive.

Canadian Pat. No. 675,101, which issued to Hanson on Dec. 3, 1963 shows a gypsum wallboard the face layers of which wrap around the respective longitidunal edges. These face layers can be peeled back to enable nails to be driven into the respective boards adjacent the edges. The face layers of Canadian Pat. No. 675,101 then can be overlapped with one another and trimmed.

Other structures similar to those described above are shown in U.S. Pat. No. 3,708,935 which issued to Kossuth et al on Jan. 9, 1973; U.S. Pat. No. 3,468,086 which issued to Warner on Sept. 23, 1969; French Pat. No. 790,248 which issued to Stevenson on May 18, 1953; and Soviet Pat. No. 791,852.

While certain of the above described references facilitate the installation of wallboards, these panels generally have not been entirely successful in concealing the seams. For example, it has been found that the edges of the face layers that are intended to mate with one another often are damaged during shipping, storage or installation, thus making the joint visually apparent. It also has been found that even if the damaged edges can be trimmed, the overhanging face layers are susceptable of being creased during either storage or installation. This crease is particularly likely to occur adjacent the edge of the substrate. Thus, although the seam may be covered on these prior art panels, it is still readily visible.

Even if the panel is carefully handled through its installation to ensure the avoidance of damage, it has been found that thermal and moisture related expansion and contraction of panels will periodically create gaps at adjacent edges. This periodic movement of the panel edges is likely to create folds or creases in the portion of the face layer which overlaps the seam between adjacent panels.

In view of the above, it is an object of the subject invention to provide a panel or wallboard capable of yielding visually unobtrusive seams between adjacent panels.

It is another object of the subject invention to provide a panel or wallboard that does not require the use of filling compounds to conceal seams between adjacent panels.

It is an additional object of the subject invention to provide face layers that can readily be trimmed to remove damaged edges and ensure precise edge-to-edge abutment.

It is still another object of the subject invention to provide a panel or wallboard with an overhanging face layer that is not likely to be damaged during installation panel.

It is yet another object of the subject invention to provide a panel or wallboard wherein the face layer is not likely to be creased or folded as a result of thermal or moisture related expansion and contraction after installation of the panel.

SUMMARY OF THE INVENTION

The subject invention is directed to a generally rectangular planar panel having a substrate and a face layer. The substrate may be formed from any of a variety of materials including wood, a plurality of laminated wood layers, particle board, gypsum board or rigid paperboard. The face layer typically will be a decorative paper, but may also be a thin wood veneer or a sheet of plastic, such as vinyl. The decorative paper or wood veneer comprising the face layer may also include a thin protective coating of plastic material. The panel may also be provided with a backing layer of paper or plastic on the side of the substrate opposite the face layer.

As noted above, the panel is rectangular in configuration. Typically the panel will be approximately 8 feet long and 4 feet wide, and thus will include a pair of opposed parallel end edges and a pair of opposed parallel side edges. In most applications, a plurality of such panels will be mounted to a wall or ceiling, such that the respective side edges of adjacent panels are in abutting edge-to-edge-relationship.

The face layer of the panel covers the entire substrate but also extends beyond one side edge of the substrate. More particularly, the face layer is substantially rectangular and includes opposed end edges that are in register with the end edges of the substrate, and further includes one side edge that is in register with a corresponding side edge of the substrate. However, the distance between the opposed side edges of the face layer is greater than the distance between the opposed sides of the substrate. Consequently the face layer includes an overhanging which extends beyond the corresponding side of the substrate. Preferably this overhang extends about 0.50 inch beyond the corresponding edge of the substrate.

The face layer is securely adhered to the central portion of the substrate, but is free of the substrate in areas adjacent the opposed side edges thereof. More particularly, the adhesive between the substrate and the face layer begins at locations thereon spaced inwardly from the side edge by approximately 0.75 inch from each side edge of the substrate. As a result the face layer can be lifted away from the substrate adjacent each of the side edges thereof.

The panel further includes a resilient strip adhered to the edge of the substrate adjacent the overhang of the face panel. This resilient strip preferably is of substantially the same thickness of the substrate plus any backing layers secured to the panel. The resilient strip extends away from the substrate a distance equal to approximately half of the overhang of the face panel. Thus, for an overhang of 0.50 inch, as described above, the resilient strip would be approximately 0.25 inch wide. Furthermore, for a 0.25 inch thick panel, the resilient strip would be approximately one-quarter inch square in cross section. Preferably the resilient strip is formed from a rubber or foam material.

In use, a first panel according to this invention is secured to a wall, ceiling or other such supporting structure by lifting back the portions of the face layer adjacent each side edge of the panel, and driving nails, screws or such through the substrate and into supporting surface. A second panel of the same type is positioned adjacent the first panel such that the resilient strip of the second panel is either abutting or slightly spaced from the edge of the first panel without the resilient strip. The face layer of the second panel is lifted back adjacent each side edge and nails or the like are driven through the substrate and into the supporting surface.

After the panels are properly mounted to the supporting surface, the respective face layers then are folded toward the substrate such that the overhanging portion of the second panel is partially on top of the face layer of the adjacent first panel.

A straight edge and a sharp tool then are used to cut through both face layers at their respective overlap. The severed portions of each face layer can be removed to provide a perfectly matched edge-to-edge seam for the face layers of the respective panels. These matched face layers then are rotated away from the substrate to enable the application of an adhesive to each substrate. The face layers then are secured into their edge-to-edge matched condition. In this manner, the seam is covered and completely obscured. Furthermore, the resilient strip between the adjacent substrates prevents the seam from ever becoming apparent through the portion of the face layer extending across the seam. Additionally, the resilient strip will help accommodate the gaps and bulges that would otherwise occur as a result of differential expansion and contraction. The resulting panel can be manufactured inexpensively and is much easier to install than panels requiring fillers to obscure seams between panels.

DETAILED DESCRIPTION OF THE PREFERRED EMBODIMENT

Figure 1:
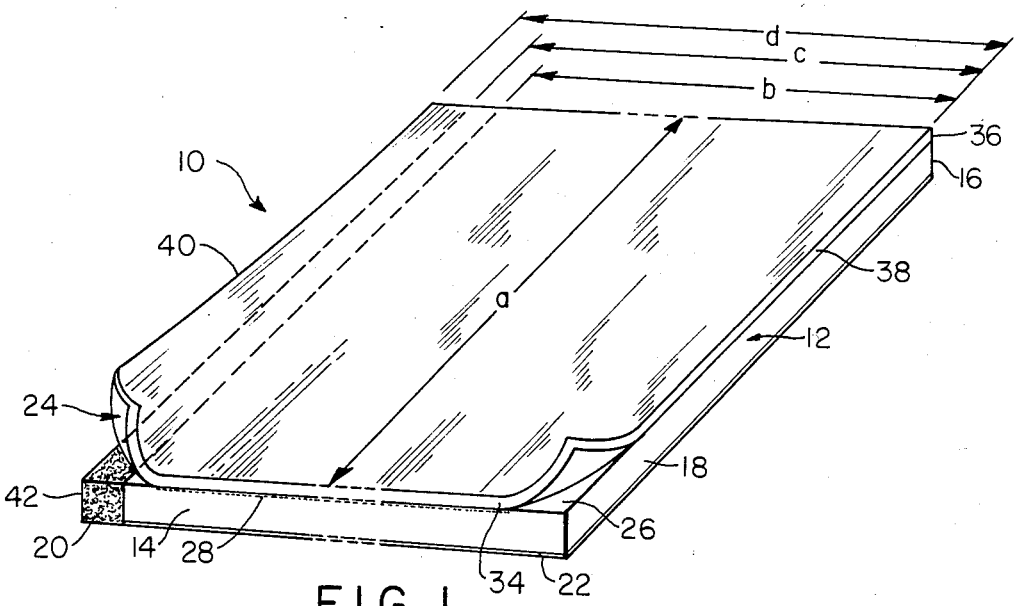
FIG. 1 is a perspective view of a panel according to the subject invention.

The panel of the subject invention is indicated generally by the numeral 10 in FIG. 1. The panel 10 is generally rectangular in shape and includes a length as indicated by dimension "a" and a width as indicated by dimension "b" in FIG. 1. The panel 10 generally will be used in the construction industry to be mounted to walls and/or ceilings. Thus, in accordance with the standards of the industry, the panel 10 typically will have a length "a" equal to 8 feet and a width "b" equal to 4 feet. Other dimensions, of course, would be equally acceptable, as would panels adapted for use used in environments other than the construction industry.

The panel 10 includes a rectangular substrate 12 which provides the principal structural support for the panel 10. The substrate 12 may be formed from a plurality of laminated layers of wood, particle board, paperboard or a gypsum material. More particularly, the substrate 12 includes opposed parallel top and bottom edges 14 and 16 respectively which are spaced apart by distance "a", which as noted above, defines the overal length of the panel 10. The substrate 12 further includes opposed first and second side edges 18 and 20 which are spaced from one another by dimension "c", which is slightly more than the overall width "b" of panel 10.

The panel 10 further includes a backing layer 22 which is adhered to the rear surface of substrate 12. The backing layer 22 is intended to protect the substrate 12 and to facilitate the handling of panel 10. A backing layer 22 is part ricularly desirable with a substrate 12 formed from paperboard, gypsum or a low grade of laminated wood. A substrate 12 formed from a higher grade of laminated wood or from particle board may not require a backing layer 22. The backing layer 22 will be substantially the same size and shape as the substrate 12 and will be secured thereto such that the respective edges of substrate 12 and backing layer 22 are in register with one another.

The panel 10 further includes a face layer 24 which is adhered to a portion of the top surface 26 of substrate 12 by adhesive 28. The face layer 24 preferably will be formed from a decorative paper which may include a protective coating of a plastic material, such as vinyl. Alternatively, the face layer 24 may comprise a sheet of decorative vinyl or a flexible sheet of wood veneer.

The face layer 24 is generally rectangular in shape and includes opposed parallel top and bottom edges 34 and 36 which are spaced apart by distance "a", such that the top and bottom edges 34 and 36 of the face layer 24 are in register with the top and bottom edges 14 and 16 of substrate 12. The face layer 24 further includes opposed parallel first and second side edges 38 and 40. The first side edge 38 of face layer 24 is disposed substantially in register with the first side edge 18 of substrate 12. The distance between the first and second side edges 38 and 40 of the face layer 24 is indicated by dimension "d" in FIG. 1. This width "d" of the face layer 24 is greater than the width "c" of the substrate 12 and also is greater than the effective width "b" of the panel 10. Specifically, the second edge 40 of face layer 24 extends approximately 0.50 inch or more beyond the second side edge 20 of the substrate 12, as indicated by dimension "e" in FIG. 2.

Figure 2:
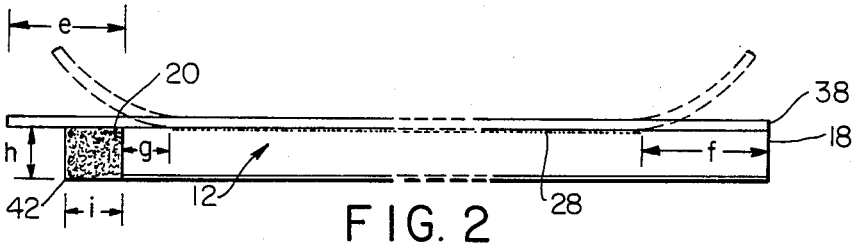
FIG. 2 is an end view of the panel shown in FIG. 1.

As illustrated in both FIGS. 1 and 2, the adhesive 28 which secures the face layer 24 to the substrate 12 covers only a generally centrally disposed area of the substrate 12. Thus, the portions of the face layer 24 disposed inwardly from both the first and second side edges 38 and 40 thereof are free of the substrate 12 and can be rotated away from the top surface 26 of the substrate 12. Preferably, as shown in FIG. 2, the adhesive 28 will terminate at a distance "f" of approximately 0.75 inch inwardly from the first side edge 18 of the substrate 12. Thus, a flap of width "f" adjacent the first edge 38 of face layer 24 can be rotated upwardly and away from the substrate 12. Similarly, the adhesive 28 terminates at a distance "g" from the second side edge 20 of substrate 12. Preferably the distance "g" is less than the distance "f", and is equal to between 0.25 inch and 0.50 inch. However, since the second side edge 40 of face layer 24 overlaps the second side edge 20 of substrate 12, a flap of between 0.75 inch and 1.00 inch of face layer 24 adjacent to the second side edge 40 thereof can be folded upwardly and away from the substrate 12.

The panel 10 further includes an elongated strip 42 of a resilient foam adhered to the second side edge 20 of substrate 12. The foam strip 42 has a thickness "h" substantially equal to the combined thickness of the substrate 12 and the backing layer 22. Additionally, the foam strip 42 has a width "i" equal to approximately 0.25 inch.

Figure 3:
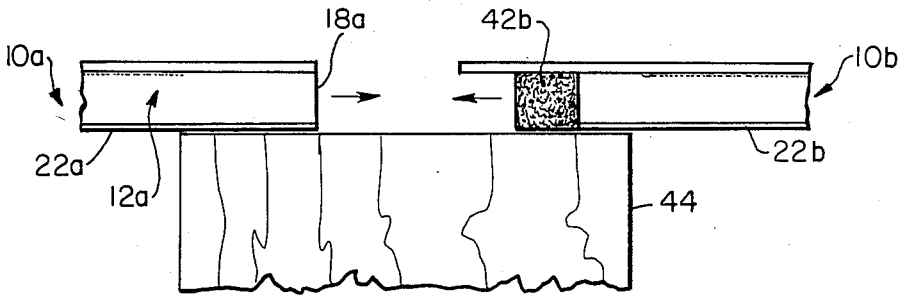
FIGS. 3–8 show various sequential steps during the installation of two panels of the subject invention.

The installation of a first panel **10*a* and a second panel 10*b* to a stud or other such support 44 is illustrated in FIGS. 3–8. With reference to FIG. 3, the panels 10*a* and 10*b* are positioned adjacent stud 44 such that the rear surfaces or backing layers 22*a* and 22*b* thereof are adjacent the stud 44. More particularly, the panels 10*a* and 10*b* are positioned such that the first edge 18*a* of substrate 12*a* on panel 10*a* is juxtaposed to the foam strip 42*b* on the second panel 10*b*. The panels 10*a* and 10*b* are advanced toward one another as indicated by the arrows in FIGS. 3 until edge 18*a* of substrate 12*a* is adjacent or slightly spaced from the foam strip 42*b* of second panel 10*b***.

Figure 4:
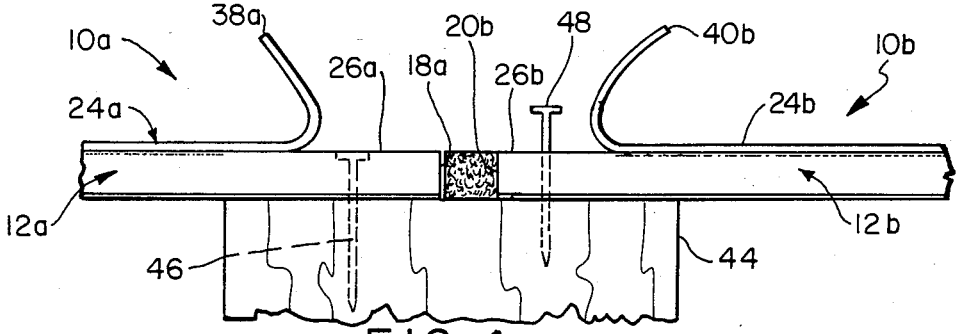

Once the first and second panels **10*a* and 10*b* are properly positioned relative to one other and relative to stud 44, the first edge 38*a* of face layer 24*a* on panel 10*a* is rotated away from the respective substrate 12*a*. Similarly, the second edge 40*b* of the face layer 24*b* on panel 10*b* is rotated away from the substrate 12*b*. As a result, as illustrated in FIG. 4, the respective portions of substrates 12*a* and 12*b* adjacent the respective first and second side edges 18*a* and 20*b* thereof are exposed. Fastening means 46 and 48 such as nails, screws, rivets or the like then are driven through the exposed portions of substrates 12*a* and 12*b* respectively to secure the associated panels 10*a* and 10*b* to stud 44. The fastening means 46 and 48 should be driven sufficiently into the stud 44 such that the respective heads thereof are flush with the top surfaces 26*a* and 26*b* respectively of the substrates 12*a* and 12*b***.

Figure 5:
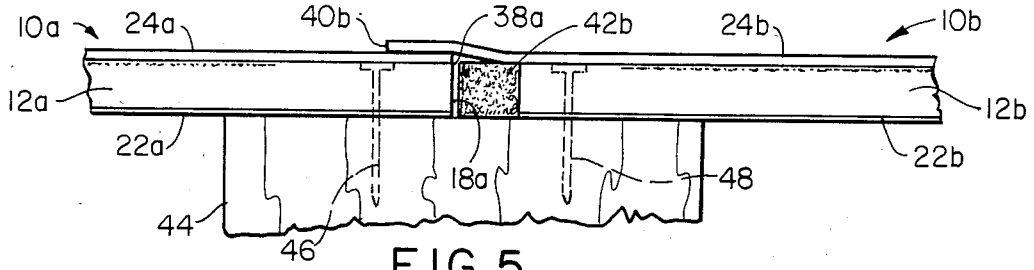
Figure 6:
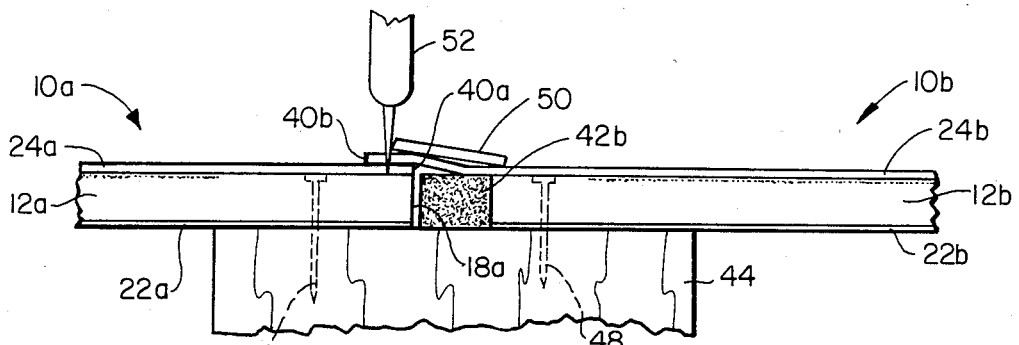

After the panels **10*a* and 10*b* have been securely fastened to the stud 44 by fastening means 46 and 48, the face layer 24*a* of panel 10*a* is rotated back into face-to-face contact with surface 26*a* of substrate 12*a*. Subsequently the portion of face layer 24*b* adjacent the second side edge 40*b* thereof is rotated into overlapping relationship with the face layer 24*a* of panel 10*a*, as illustrated in FIG. 5. A straight edge 50 and a sharp cutting implement 52, such as a razor, are then used to cut entirely through the overlapped portions of face layers 24*a* and 24*b*. This simultaneous severance of layers 24*a* and 24*b*, as illustrated in FIG. 6, enables face layers 24*a* and 24*b* to be perfectly matched in edge-to-edge relationship on the surface 26*a* of substrate 12*a*. More particularly, after the layers 24*a* and 24*b* have been simultaneously severed, the severed portion of face layer 24*b* adjacent the second side edge 40*b* thereof is removed and the portion of face layer 24*a* adjacent the first side edge 38*a* thereof is removed. The remaining edges of face layers 24*a* and 24*b*** created by the simultanous severance will be precisely in line with one another and capable of being positioned in matched edge-to-edge relationship.

Figure 7:
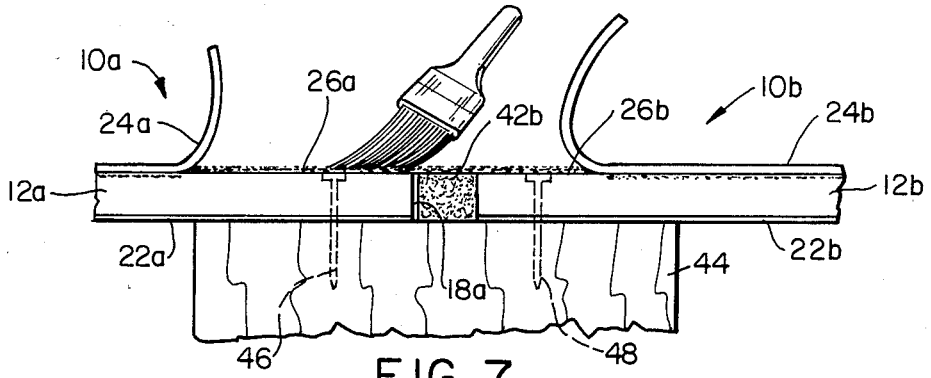
Figure 8:
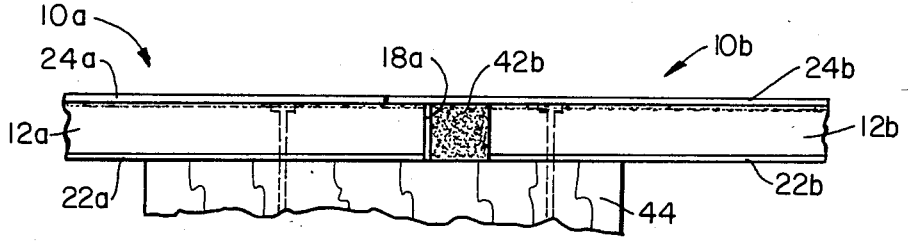

After the face layers **24*a* and 24*b* have been severed for matched edge to edge abuttment, the respective face layers 24*a* and 24*b* are rotated away from the respective substrates 12*a* and 12*b*, and an adhesive 54 is applied to the exposed portions of substrates 12*a* and 12*b* adjacent the respective side edges 18*a* and 20*b* thereof, as shown in FIG. 7. Finally, the face layers 24*a* and 24*b* are rotated back into with contact substrates 12*a* and 12*b* and are securely adhered thereto in precisely matched edge-to-edge relationship as shown in FIG. 8. As an alternative to the above, the face layers 24*a* and 24*b* can be provided with a preapplied adhesive which is protected by a release paper. The release paper then can merely be peeled away such that the face layers 24*a* and 24*b* can be securely adhered to the substrates 12*a* and 12*b***.

As shown in FIG. 8, the foam strip **42*b* bridges the gap between substrates 12*a* and 12*b* and is completely covered by the face layer 24*b*. Thus, the foam strip 42*b* prevents sagging, folding or creasing that might otherwise occur in the face layer extending across the seam between panels 10*a* and 10*b*. Although the foam strip 42*b* is shown as being slightly spaced from edge 18*a* of panel 10*a*, the foam strip 42*b* may be placed in direct contact with edge 18*a* of substrate 10*a* or may be spaced a slightly greater distance away from edge 18*a* than illustrated in FIG. 8. With any of these options, the foam strip will efficiently support the face layer 24*b* and avoid making the seam between panels 10***a* and 10*b* visually apparent.

Figure 9:
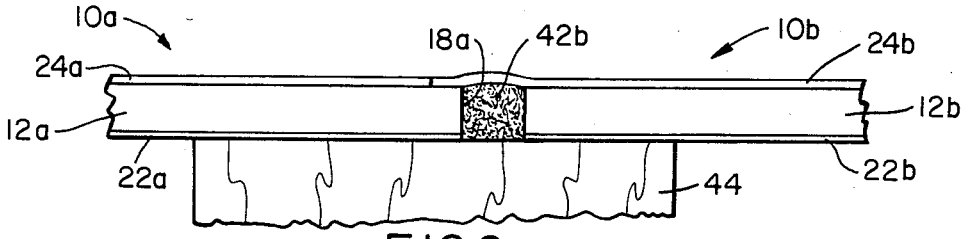
FIG. 9 is an end view of two installed panels under conditions of thermal expansion.

The foam strip 42 of panel 10 also prevents the creation of folds, creases or such as a result of transient conditions of thermal or moisture related expansion or contraction. More particularly, as shown in FIG. 9, an expansion of panel 10*a* and/or panel 10*b* will bring the edges 18*a* and 20*b* of substrates 12*a* and 12*b* closer together. This condition, as shown in FIG. 9 will cause a slight bulging of the foam strip 42*b*. This bulging will follow a flat arcuate shape and will not be significantly visually apparent. More importantly, any transient nonplanar configuration of the face layer 24*b* will be sufficiently supported by the foam strip 42*b* to prevent a permanent distortion to the face layer 24*b* that otherwise would effectively damage the quality of the seam between panels 10*a* and 10*b*. When the transient conditions of heat and/or moisture change, the panels 10*a* and 10*b* will return to their original shape and the face layer 24*b* will reassume the planar condition illustrated in FIG. 8.

In summary, a panel is provided with a substrate and a face layer secured thereto. The relative sizes and dimensions of the substrate and the face layer are such that three edges thereof are in register with one another but the remaining edge of the face layer overlaps the corresponding edge of the substrate. The portions of the face layer adjacent each side edge are free of the substrate and can be rotated away from the substrate. A resilient strip is adhered to the edge of the substrate adjacent the overhanging portion of the face layer. The face layer can be lifted away from the substrate to enable the panel to be nailed to a supporting structure through the substrate. The face layer then can be rotated over the nails to completely obscure them. Furthermore, the overlapping edge of the face layer on one panel can be laid on top of the adjacent edge of another panel. The overlapping face layers can be simultanously trimmed to enable a perfectly matched edge to edge seam that will not be visually obtrusive. This seam of the face layers will be on top one of the substrates. The resilient strip supports the face layer between adjacent substrates to prevent the seam from becoming visually apparent.

While the invention has been described with respect to a preferred embodiment, it is apparent that various changes can be made therein without departing from the scope of the invention as defined by the appended claims.

What is claimed is:

1. A generally rectangular planar panel comprising:

a generally rectangular substrate having opposed parallel top and bottom edges and opposed parallel first and second side edges;

a strip of resilient material adhered to the second edge of said substrate; and a generally rectangular face layer adhered to portions of said substrate inwardly spaced from the first and second edges thereof, said face layer including opposed top and bottom edges and a first side edge which are disposed respectively substantially in register with the top, bottom and first side edges of said substrate, said face layer further including a second side edge overhanging the strip of resilient material adhered to the second side edge of said substrate, whereby portions of said face layer adjacent said first and second side edges of said substrate can be lifted away from the substrate.

2. A panel as in claim 1 wherein the substrate comprises a plurality of layers of laminated wood.

3. A panel as in claim 2 wherein the substrate comprises a particle board.

4. A panel as in claim 1 wherein the substrate comprises a reinforced paperboard.

5. A panel as in claim 2 wherein the substrate further comprises a backing sheet formed from a paper material.

6. A panel as in claim 1 wherein the face layer comprises a decorative paper.

7. A panel as in claim 6 wherein the face layer further comprises a protective plastic coating on the side of said face layer opposite the substrate.

8. A panel as in claim 1 wherein the face layer comprises a decorative plastic material.

9. A panel as in claim 1 wherein the strip of resilient material is a strip of foam.

10. A panel as in claim 9 wherein the strip of foam extends from said substrate approximately one-quarter inch.

11. A panel as in claim 1 wherein the face layer overhangs the second side edge of said panel between one-quarter inch and one inch.

12. A panel as in claim 1 wherein the face layer is adhered to portions of the substrate disposed inwardly from said first and second side edges by approximately one-half inch to one inch.

* * * * *